United States Patent [19]

Letard et al.

[11] Patent Number: 4,473,017

[45] Date of Patent: Sep. 25, 1984

[54] APPARATUS FOR AUTOMATICALLY HEMMING TUBULAR GARMENTS ON A SEWING MACHINE

[75] Inventors: Michel Letard; Daniel Renouvin, both of Saint Pierre d'Entremont, France

[73] Assignee: AMF Inc., White Plains, N.Y.

[21] Appl. No.: 450,404

[22] Filed: Dec. 16, 1982

[30] Foreign Application Priority Data

Nov. 30, 1982 [FR] France ..... 82 02343

[51] Int. Cl.[3] ..... D05B 35/04

[52] U.S. Cl. ..... 112/141; 112/121.26; 112/147; 112/305; 112/322

[58] Field of Search ..... 112/305, 141, 142, 143, 112/322, 121.26, DIG. 3, 147

[56] References Cited

U.S. PATENT DOCUMENTS

| | | | |
|---|---|---|---|
| 3,176,638 | 4/1965 | Goppert | 112/322 |
| 3,631,826 | 1/1972 | Morgan | 112/141 |
| 3,783,805 | 1/1974 | Guichard | 112/121.26 X |
| 3,865,058 | 2/1975 | Rovin et al. . | |
| 3,890,911 | 6/1975 | Babson et al. . | |
| 4,037,547 | 7/1977 | Marforio | 112/143 |
| 4,098,201 | 7/1978 | Adamski, Jr. et al. . | |
| 4,191,117 | 3/1980 | Torre . | |
| 4,287,841 | 9/1981 | Rovin | 112/147 X |

FOREIGN PATENT DOCUMENTS

| | | |
|---|---|---|
| 625300 | 2/1936 | Fed. Rep. of Germany . |
| 1349350 | 4/1974 | United Kingdom . |

*Primary Examiner*—Werner H. Schroeder
*Assistant Examiner*—Andrew M. Falik
*Attorney, Agent, or Firm*—David E. Dougherty; Thomas J. Durling

[57] ABSTRACT

An apparatus for use with a sewing machine to automatically hem the free ends of tubular portions of garments. The apparatus has a guide cylinder with a stop and a tension cylinder capable of being retracted, both of which are mounted on the sewing machine with a folding guide which is moveable between a retracted position and an operative position. A tube connected to a source of compressed air assists in removing the sewn garment from the apparatus.

6 Claims, 7 Drawing Figures

APPARATUS FOR AUTOMATICALLY HEMMING TUBULAR GARMENTS ON A SEWING MACHINE

This invention relates to apparatus which is mounted on conventional sewing machines for automatically hemming the free ends of tubular portions of clothing such as, for example, sleeves and legs.

Up until now, a hem at the end of a tubular portion of a garment, has been made essentially by hand by twice folding the free end of the fabric and engaging the inner fold of the hem by a guide provided on a sewing machine in front of the pressor foot. Then, the hem is sewn while the operator hand guides the folded end taking care to maintain the end fold in correct alignment with the needle and the guide.

An object of the present invention is to considerably reduce manual manipulation by apparatus for automatically forming the inner fold of a hem as well as sewing the hem.

The object and advantages of the invention will become more apparent in the detailed description of a preferred embodiment which follows.

The object of the invention is achieved by apparatus mounted on any sewing machine capable of sewing hems at the free ends of sleeves and legs of garments. A machine of this type comprises a presser foot associated with a needle, a platen on which the presser foot presses the farbic to be sewn, and a feed or drive roller which advances the material under the presser foot. Such a conventional machine also comprises a guide which folds the fabric and keeps it folded in front of the needle as the fabric advances. According to the present invention, this conventional guide is not used.

The apparatus according to the invention comprises a first guide cylinder freely rotatable on an axis perpendicular to the general plane of the hem stitching to be made, this cylinder being associated with a stop or fixed piece for the folded material and having preferably a circular throat or groove in the plane of the hem stitching; a second tension cylinder freely rotatable which is parallel to the first cylinder and is movable between a first, retracted position and a second, tension position; and a folding guide supported between the first cylinder and the pressor foot, this guide being movable between a retracted position and an active position in which it makes the second fold of the hem in front of the needle in the direction of the stitching.

Preferably within the spirit of the invention there is a driving means for the material under the presser foot other than the normal operation of the sewing machine. It is advantageous to use for this purpose the usual driving or feed roller existing on the machine by providing on the motor shaft of this roller a suitable means such as a free wheel associated with an auxiliary motor permitting or causing it to turn alone with the sewing machine operating.

According to a preferred embodiment of the invention, an air blowing nozzle or tube is placed between the guide cylinder and the tension cylinder connected to a source of pressurized air with a valve capable of opening the source to the nozzle or tube for a moment after the stitching of the hem.

In describing one embodiment of the invention, reference will be made to the attached drawings in which.

Figure 7:
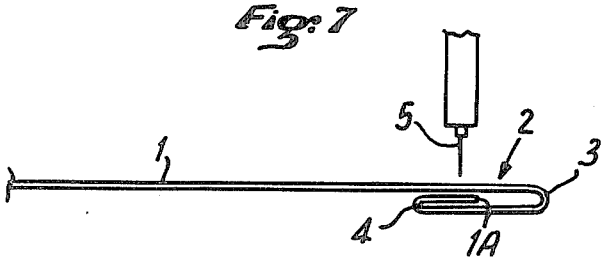

FIG. 7 diagrammatically shows a hem for defining the terms used.

In the following it is assumed that a tubular part 1 of a garment terminates in a hem 2 constructed by a first or outer fold 3 and a second or inner fold 4. Needle 5 of a sewing machine makes a stitching which joins together the three thicknesses of the material or fabric and constitutes what is called here the stitching or sewing the hem. Up till now, the fold 3 was made by hand, the fold 4 started by hand and then introduced by hand into a guide while the material was driven or fed under the needle 5. This material is guided by hand during all stitching and consists of maintaining the outer fold 3 correctly formed at a constant distance from the needle 5 and ensuring the suitable entry of the fabric or material into the guide for a correct formation of the inner fold 4.

According to the invention, only the outer fold 3 is manually made before the machine begins operating and all other operations are performed automatically.

A hem sewing machine comprises in addition to the needle 5, a presser foot 6 which is raised and lowered such that, when it is lowered, it applies the material to be sewn against a platen or plate 7 which is associated with a driving or feed roller 8. Below this an idler roller 9 is located opposed to the driving roller 8. It is not necessary to describe further these well known conventional members.

The apparatus of the invention can be mounted on any hem sewing machine and comprises a first guide cylinder 10 cylinder freely rotatable in a bearing 11 fixed to the machine in front of the needle 5 in the direction of the stitching. This cylinder 10 extends towards the outside of the machine level with the plate 7 such that its geometric axis of rotation is perpendicular to the general plane of the hem stitching which contains the needle 5.

Figure 1:
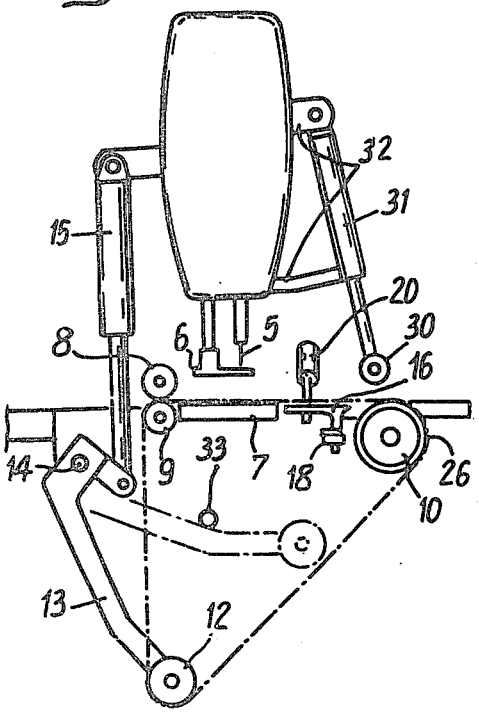
FIG. 1 is a partial front view of a sewing machine, provided with an automatic hemming apparatus according to the invention.

The apparatus of the invention comprises also a second or tension cylinder 12 which is freely rotatable and mounted on the end of an arm 13 below the plate 7. This arm 13 can pivot around a pivot 14 fixed to the machine. In order to carry out its movement, the arm 13 is connected to the piston rod of a jack 15 which is itself is pivotally connected at its opposite end to the sewing machine. The tension cylinder 12 may be placed in a first, retracted position shown in dot and dash lines in FIG. 1 and in a second tension position shown in solid lines in the same FIG. 1.

Figure 4:
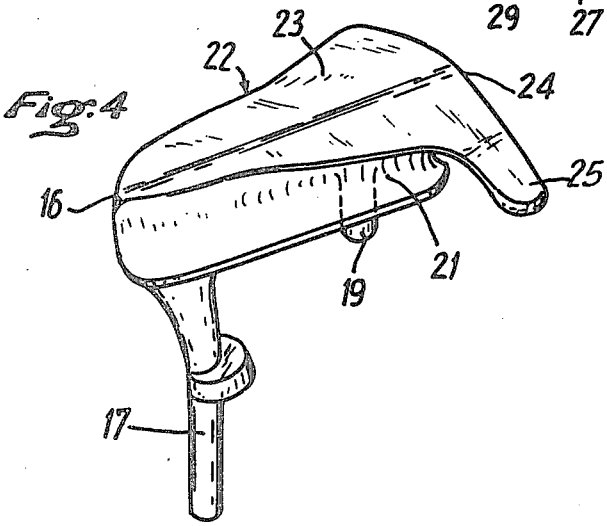
FIG. 4 is a perspective view of the folding guide forming part of the apparatus of the invention.

The apparatus of the invention also comprises a folding guide 16, shown more clearly in FIG. 4, having its lower face at one of its ends provided with a stem 17 which is supported in a bearing 18 fixed to the machine. In addition, the guide 16 has under the same lower face a boss 19 spaced from the stem 17 by which it may be coupled to the rod of a jack 20 which causes the folding guide 16 to pivot between the first, retracted position (see FIG. 5) and the second active position (see FIG. 6). In a plane substantially perpendicular to the stem 17 and the boss 19, the folding guide 16 is provided with a lateral fold groove or throat 21 which is located on a suitable side of a body 22 terminated by a slightly arched or convex upper face 23. The folding groove or throat 21 commences substantially opposite the location of the stem 17 and extends moving away from this latter and becoming more concave up to the opposite end 24 of the body 22. At this end 24, the upper face 23 is extended to form a fin or tucker 25 which extends toward the outside passing crosswise or transversely above the fold groove 21 which it contributes to form.

Figure 2:
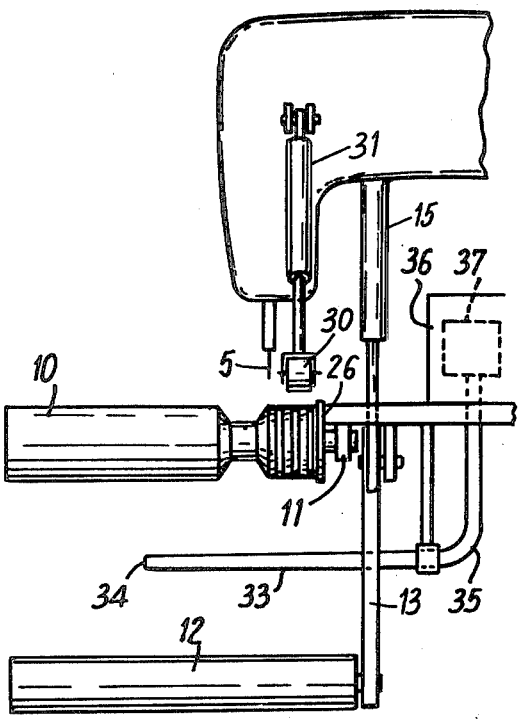
FIG. 2 is a side view of the machine of FIG. 1 and of the apparatus of the invention.

The guide cylinder 10 comprises at its end nearest the machine a shoulder which constitutes a fixed piece or stop 26 and a short length end portion 27 having a non-slip surface. Such surface is obtained by any suitable known means, for example, by rubber bands 28, circular and partly housed or lodged in suitable grooves. The end portion 27 is located at the right (as seen in FIG. 2) of the driving or feed roller 8 and of the idler roller 9 so as to ensure the tension and the guiding of the material during its passage under the presser foot 6 during stitching. The mounting of the cylinder 10 and of the bearing 11 is effected at the level determined by this condition and by the diameter of cylinder 10. Adjacent the end portion 27, the cylinder 10 has a throat or groove 29 from which cylinder 10 extends with a diameter equal to that of this part 27 to its other extremity.

When the apparatus of the invention is used, the fold guide 16 and the second tension cylinder 12 are put in their retracted positions with the presser foot 6 being raised. A sleeve or a leg to be hemmed is then drawn or slipped onto the cylinder 10 having only the outer or external fold 3 prefolded. The folded edge 3 is positioned against the stop 26 (see FIG. 3). It will be noted that the stop 26 can be a fixed stop independent of the cylinder 10. However, it is preferable for it to be an integral part of the cylinder and rotate with it.

For a better or improved material guiding during sewing or stitching it is also desirable, although not necessary in all circumstances, to associate with the cylinder 10, an auxiliary roller 30 rotatably mounted to piston rod a jack 31 which, in turn, is mounted on the machine by suitable supports 32. The roller 30 is moved away from the cylinder 10 by retraction of the jack 31 before putting fabric or material in place and is then applied against the latter to the non-skid end part 27 of the cylinder 10.

Figure 3:
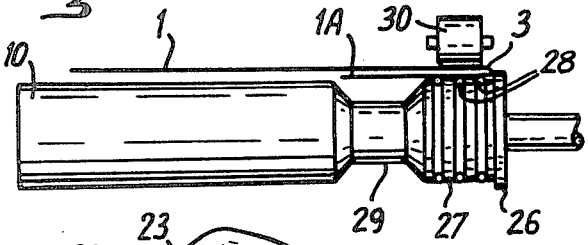
FIG. 3 is an enlarged side view of the first guide cylinder forming a part of the apparatus.

In FIG. 3, the roller 30 is intentionally shown in a retracted position to show the material or fabric 1 and the fold 3 which is also drawn slightly open. In reality, the fold 3 is flattened out and the two thicknesses of the material touch one another due to the effect of the tension created by the cylinder 12 which is put in its position of tension when the material has been put in place with its fold 3 as has been explained.

In this state of the apparatus with the fold 4 not yet existing, the free terminal edge 1A of the material or fabric 1 is located in the region of the groove or throat 29 of the cylinder 10. The folding guide 16, which in reality is a folder-tucker, is withdrawn or retracted from the free edge 1A, and is rotatably supported by the bearing 18 in an intermediate region located between the cylinder 10 and the stitching defined by the presser foot 6 and the needle 5. The bearing 18, is slightly inclined or, as a variation, the upper face 23 of the fold guide 16 is formed so that the fin 25 is applied against the material or fabric which is in a state of tension.

Figure 5:
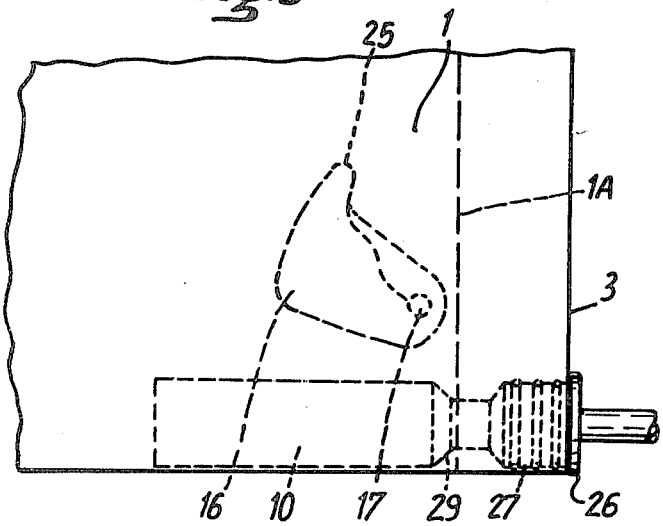
FIGS. 5 and 6 are top views of the guide cylinder and of the fold guide serving to explain their operation.
Figure 6:
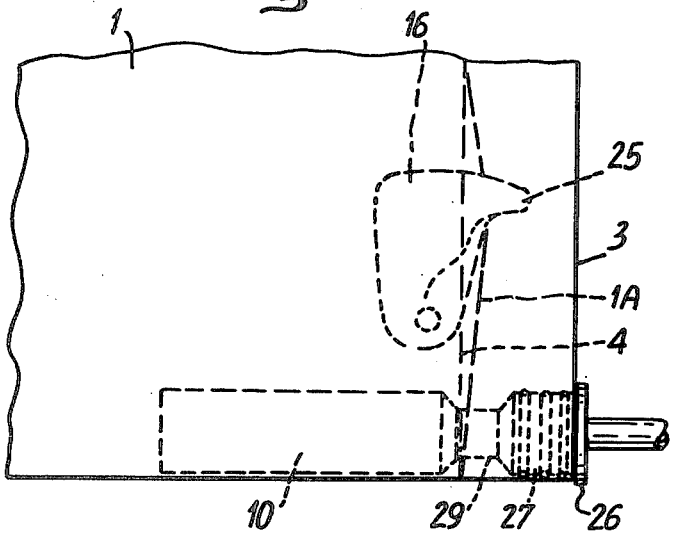

The folding guide or folder-tucker 16 is pivoted about the axis of stem 17 by the jack 20 in clockwise direction from the position shown in FIG. 5 to its active position shown in FIG. 6 in which the groove or throat 21 extends generally parallel to the folded edge 3 in a transverse plane to the groove or throat 29 of the cylinder 10 to the right of the stitching zone. During this movement, the fin 25 contacts the free edge 1A of the material 1 and tucks or pushes it towards the fold 3 thereby starting the formation of the inner, or interior fold 4. When pushed back, the free edge 1A, which was perpendicular to the cylinder 10, becomes oblique, as it approaches fold 3. The provision or existence of groove or throat 29 facilitates this oblique positioning of the free edge 1A.

The groove or throat 29 could be eliminated or dispensed with if, between the cylinder 10 and the fold guide 16, there is provided a distance large enough for the free edge 1A to have sufficient freedom, in spite of tension of the cylinder 12, to be able to move to the oblique or displaced position.

For greater capacity or efficiency of the apparatus, it is preferable to bring the folding guide 16 and the cylinder 10 close together and to provide the groove or throat 29.

When the fold 4 has been started as shown in FIG. 6, the material or fabric 1 is turned over a length of a few centimeters around the cylinders 10, 12 and the roller 9 without lowering the presser foot 6 and without operating the needle 5. Any suitable feed or driving means for the material 1 can be used. It is especially advantageous to use the driving roller 8 already provided for this purpose on the sewing machine. In order not to cause the roller 8 to rotate or be driven by the machne motor which would operate the needle 5, a free wheeling means is interposed (not visible in the Figures) on the shaft of the roller 8 and this latter is caused to turn or is driven by means of an auxiliary motor (not shown). When the material or fabric 1 has been displaced by rotation over a few centimeters, the inner fold 4 has been formed correctly by the groove or throat 21. As soon as the fold 4 passes the needle 5, the presser foot 6 is lowered and the machine begins to operate and sew the hem. Before the start or beginning of the stitching reaches the folding guide 16, the folding guide is returned to its retracted position and a few centimeters are resewn to ensure that the stitches overlap.

As shown in FIG. 2, the automatic operation of the apparatus in accordance with the invention can be improved by providing the apparatus with an air flow tube or pipe 33 disposed between and preferably parallel to the cylinders 10 and 12. The end 34 of the tube or pipe 33 is open in the direction of the inside of the sleeve or the leg during hemming the opposite end of the tube or pipe 33 is connected by a tube 35 to a source or air 36 under pressure at 8 bars, for example. The tube 35 is provided with a normally closed valve 37.

When the sewing of a hem is terminated the sleeve or the leg has made a full revolution or complete turn on itself. This rotational movement twists or causes a narrowing of the tubular member (sleeve or leg) before its connection to the rest of the garment. Consequently, as soon as the presser foot 6 has been raised and the tension cylinder 12 has been returned to its retracted position, opening the valve 37 produces a flow or rush of compressed air which ejects the sleeve or leg from the machine. This assumes that the needle 5 has been stopped above the material or fabric 1 and that the thread has been cut. Existing sewing machines are equipped with a thread cutter and a control means to the position of the needle when the machine stops sewing. These two means, therefore, do not form a part of the apparatus of the invention.

Immediately after the ejection of the hemmed tubular portion of a garment, the machine is ready to receive the new sleeve or leg of another garment with its outer fold 3 made manually. All the resulting operations which follow as previously described are carried out automatically by command and under the control of known automatic means (detectors, cam shaft, programmer etc.). The automatic execution or formation of the inner fold 4 and of the hem stitching leaves just enough time to prepare the next sleeve or leg with its outer or exterior fold 3 and put in place as soon as the automatic cycle has terminated by the ejection of the hemmed sleeve or leg. In this way, it is possible to double the rate of making hems at the ends or extremities of sleeves and legs of garments.

Although but a single embodiment of the invention has been illustrated and described in detail, it is to be expressly understood that the invention is not limited thereto. Various changes may be made in the design and arrangement of parts without departing from the spirit and scope of the invention as the same will now be understood by those skilled in the art.

What is claimed is :

1. Apparatus in combination with a sewing machine having a needle, a presser foot and a rotatable feed roller, the apparatus adapted to be driven with the sewing machine during its operation for forming and sewing a hem at the end of a tubular portion of material, and comprising:

(a) a guide cylinder rotatably mounted upstream of the needle in the direction of the sewing, the guide cylinder having an annular shoulder adjacent to one end to act as a material stop and defining an annular groove spaced from the material stop so as to accommodate a folded over edge of the material at reduced tension;

(b) a tension cylinder disposed substantially parallel to the feed roller and the guide cylinder, and movable between a retracted position and a material tensioning position;

(c) a folding guide having a lateral throat disposed between the presser foot and the guide cylinder, the folding guide being movable between a retracted position and an active position wherein the lateral throat is disposed adjacent to the annular groove opposite the material stop and engages the edge of the material to form an interior fold of the hem; and, (d) means disposed between the feed roller and the guide and tension cylinders to provide an air jet in a direction transverse to the direction of sewing.

2. Apparatus in accordance with claim 1 further comprising non-slip means on the surface of the guide cylinder between said annular shoulder and said annular groove.

3. Apparatus in accordance with claim 2, further comprising a guide roller disposed parallel to said guide cylinder in alignment with said non-slip means; and means for moving said guide roller toward and away from said cylinder.

4. Apparatus in accordance with claim 1, wherein said folding guide further comprises a body having an upper face; and a fin extending from said body transverse to and above said lateral throat.

5. Apparatus in accordance with claim 4, wherein said fin extends from one end of said body of said folding guide; and further comprising a pivot member extending downwardly from said body at its end opposite from said fin.

6. Apparatus in accordance with claim 8, further comprising a boss spaced from said pivot member depends from said body and is connected to driving means for moving said folding guide on said pivot between its retracted and active positions.

* * * * *

UNITED STATES PATENT AND TRADEMARK OFFICE

CERTIFICATE OF CORRECTION

PATENT NO. : 4,473,017

DATED : September 25, 1984

INVENTOR(S) : Michel Letard, Daniel Renouvin and Joseph Dupont

It is certified that error appears in the above-identified patent and that said Letters Patent is hereby corrected as shown below:

On the title page, Item [75] should read:
--Michel Letard; Daniel Renouvin; and Joseph Dupont, all of Saint Pierre d'Entremont, France --

Signed and Sealed this

*Tenth* Day of *September 1985*

[SEAL]

*Attest:*

DONALD J. QUIGG

*Attesting Officer* *Acting Commissioner of Patents and Trademarks - Designate*